US005086525A

United States Patent [19]

Christopher

[11] Patent Number: 5,086,525

[45] Date of Patent: Feb. 11, 1992

[54] MOISTURE-PROOF SPA COVER AND METHOD OF CONSTRUCTION

[76] Inventor: Larry D. Christopher, 1364 S. Kendall Ct., Lakewood, Colo. 80226

[21] Appl. No.: 509,372

[22] Filed: Apr. 13, 1990

[51] Int. Cl.[5] ..... E04H 4/00; A47K 3/02

[52] U.S. Cl. ..... 4/498; 4/580

[58] Field of Search ..... 4/498, 503, 580; 220/215, 339; 156/212, 213, 214, 308.4, 308.2, 221, 475

[56] References Cited

U.S. PATENT DOCUMENTS 4,422,192 12/1983 Jacobs ..... 4/498

OTHER PUBLICATIONS

Sta-Warm Industries, Winter 1986, Advertisement in "Canadian Pool & Spa Marketing".

Advertisement in "Spa Trade Journal and Sauna" Starlite Leisure Products Inc., Jul. 1990.

Advertisement in "Aqua" Olympic Spa Covers, Feb. 1989.

Classic Covers, Feb. 1986 Advertisement in "Spa and Sauna".

ATA Industries, Mar. 1982 Advertisement in "Spa and Sauna".

Sentinel Pool Products brochure.

*Primary Examiner*—Henry J. Recla

*Assistant Examiner*—David J. Walczak

*Attorney, Agent, or Firm*—Beaton & Swanson

[57] ABSTRACT

An improved design and method of construction for spa or hot tub covers. The top panel and bottom panel of a first cover are each unitary and are heat sealed together to provide a superior moisture-proof cover. A second cover is constructed in the same manner and the two covers are hingedly attached together with a heat sealed flange integral with the top and bottom panels of each cover.

18 Claims, 7 Drawing Sheets

MOISTURE-PROOF SPA COVER AND METHOD OF CONSTRUCTION

FIELD OF THE INVENTION

This invention relates to an improved design and method of construction for spa or hot tub covers. In particular, this invention provides for unitary design of the cover encasement top and heat seal construction to provide a superior moisture-proof cover.

BACKGROUND OF THE INVENTION

The basic design of a cover for a spa or hot tub (collectively referred to in this disclosure as a "spa") is well known in the art. The design essentially comprises a single piece or several pieces of rigid material, typically a thermally insulating material, encased in a water-resistant sheet material. The rigid material is shaped to cover the top opening of a particular design of spa. Handles are attached to the encasing sheet material to aid removal of the cover, and securing tabs are similarly attached to secure the cover onto the top opening of the spa.

A spa cover of this basic design performs several functions. The cover reduces loss of heat from the water in the spa. The cover prevents entry of debris into the spa. The cover prevents accidental injury of small children and others who might fall into the spa. Because spas are often located outside any protective structure, the cover also prevents the entry of natural elements such as rain, snow, sleet and hail into the spa. The present invention performs all these functions.

In typical previous designs at least six separate pieces of sheet material are required to encase the rigid material: top, bottom, side and end gussets, flaps, handles, and tabs. Often the gussets and flaps are produced from scrap material and so may be comprised of a plurality of even smaller pieces of sheet material. In previous designs these pieces of sheet material are sewn together inside out and then turned right side out to form the encasement.

Previous designs of a spa cover encasement formed by a plurality of sheet material pieces sewn together have proved unsatisfactory. When exposed to natural elements over a period of time the sewn seams inevitably allow moisture to penetrate inside the spa cover. This results in the formation of mold and mildew in the spa cover.

Construction of such a spa cover encasement may take an unacceptably long time because of the presence of a plurality of seams which must be sewn. A reduction in the time of construction, a labor intensive activity, will significantly reduce the cost of the completed spa covers.

SUMMARY OF THE INVENTION

The present invention discloses a superior spa cover design and method of construction, which result in a completely moisture-proof spa cover that can be constructed in significantly less time than previous designs. The present invention discloses a unitary spa cover encasement top with fewer seams. The seams are heat sealed, not sewn, eliminating moisture penetration into the spa cover. The reduced number of seams and heat seal method of construction significantly reduce the time required to produce a spa cover.

DESCRIPTION OF THE PREFERRED EMBODIMENT

The spa cover designed and constructed as described in the preferred embodiment is for use on a spa configured with a top opening which is approximately square, with each side of the spa top opening approximately 84 inches long. The 84-inch square spa is one of several common configurations. It will be apparent that this invention may be employed with many other spa configurations.

Figure 1:
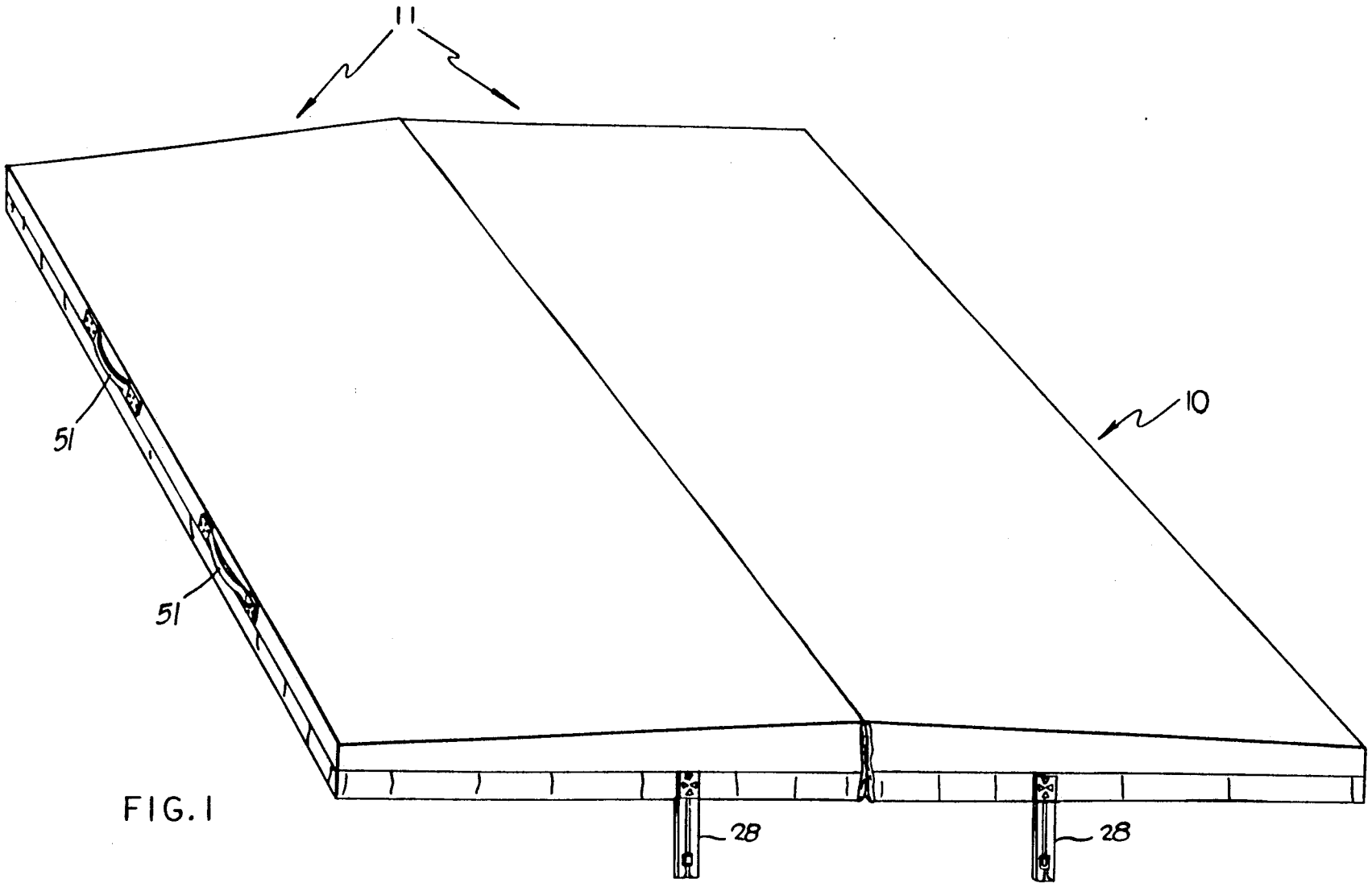
FIG. 1 is a perspective of the spa cover constructed according to this invention.
Figure 11:
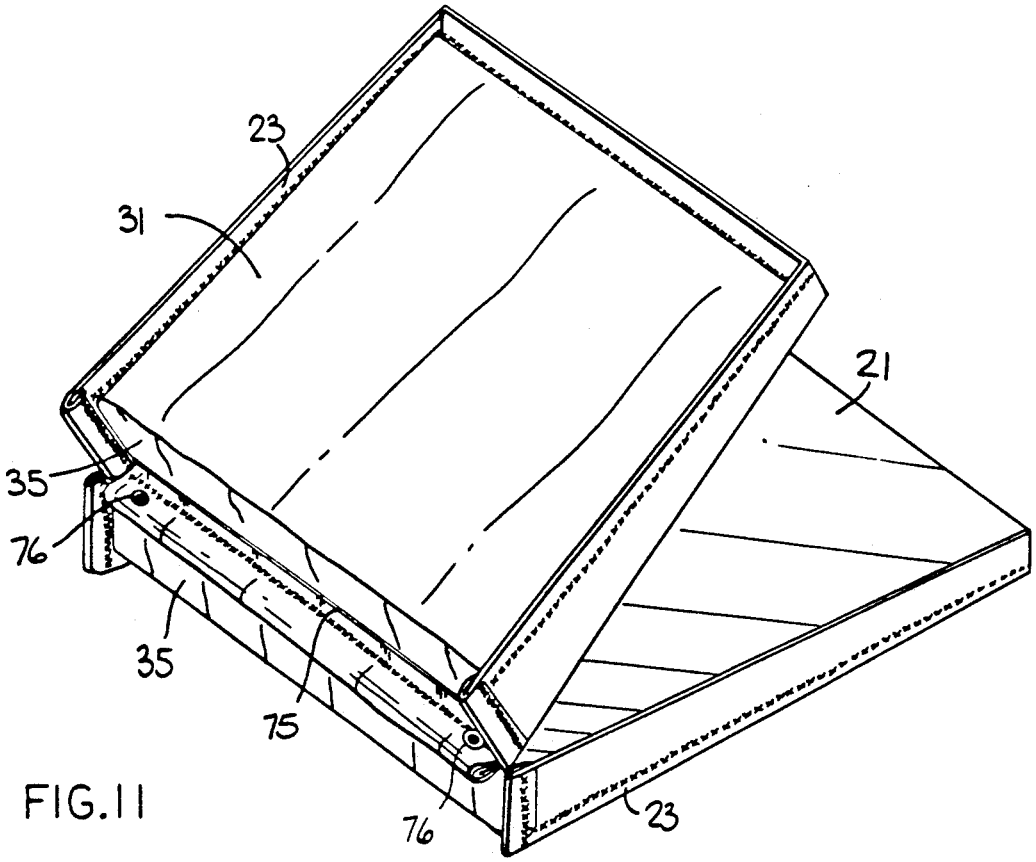
FIG. 11 is a perspective view of the spa cover constructed according to this invention showing the hinge construction.

The spa cover 10, shown in FIG. 1 and FIG. 11, essentially is comprised of two cover halves 11 joined along a connecting edge to form a hinge 75. Each cover half 11 essentially is comprised of a top panel 20, bottom panel 30, a rigid material insert 40 placed between the panels, and one or more handles 51 and securing tabs 28.

The preferred embodiment will first describe the design of the major components of the spa cover 10. The construction of the major components into spa cover 10 will then be described.

Figure 2:
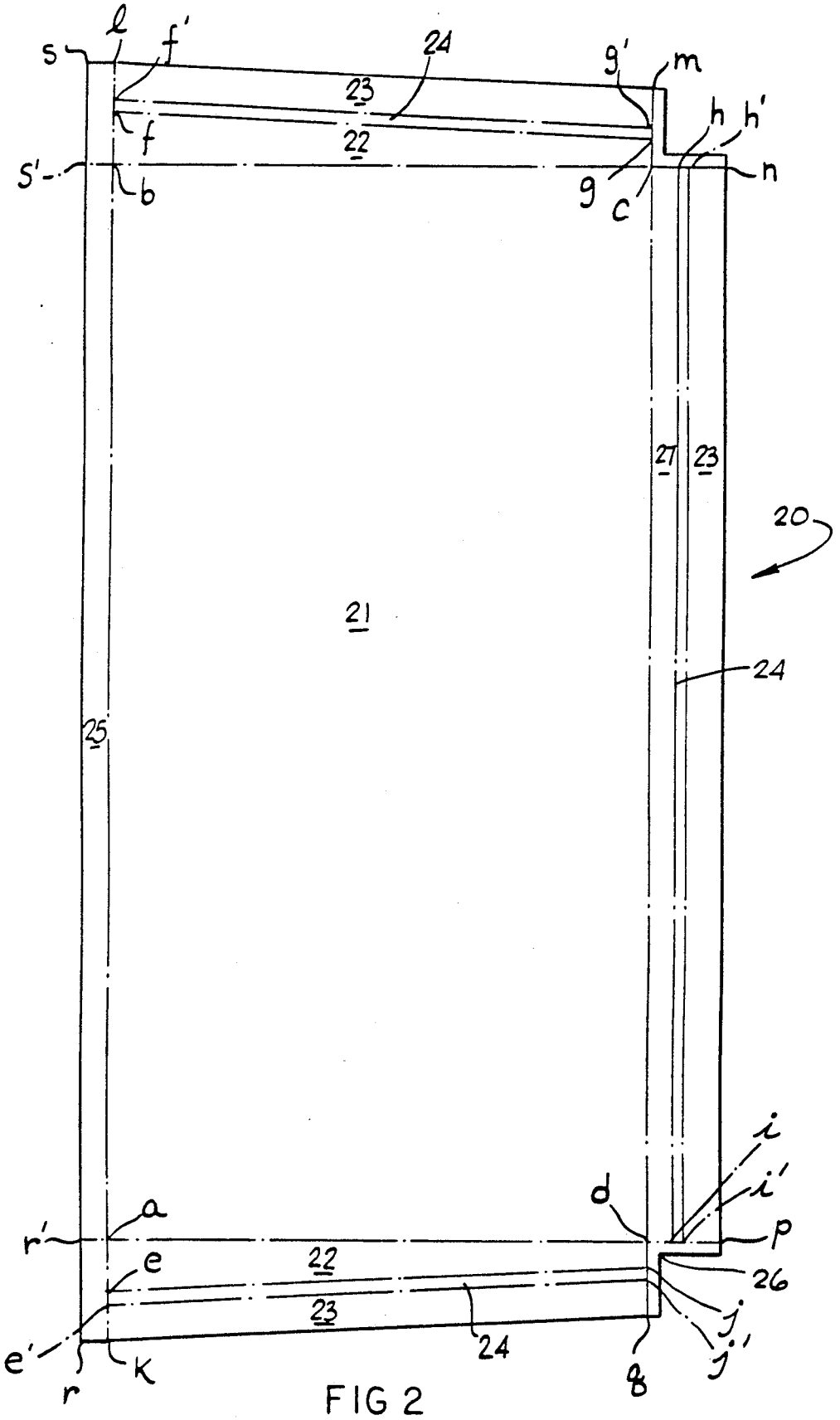
FIG. 2 is a plan view of the top panel of a cover half, showing various sections of the panel before folding and assembly.

Top panel 20 is shown in FIG. 2. Top panel 20 is a single piece of sheet material such as expanded vinyl. The preferred embodiment uses expanded vinyl sold by CGPC America Corp., of Cerritos, Calif. under the name "Leisure Time."

Central section 21 of top panel 20 is bounded by the points abcd. In the preferred embodiment, to be used with an 84-inch square spa, length ab and length cd measure 84 inches each; length ad and length bc measure 42 inches each. Side panel sections 22 are bounded by the points bfgc and eadj. End panel section 27 is bounded by the points dchi. Length bf and length ae measure four inches each; lengths cg, ch, di and dj measure two inches each. When constructed the spa cover 10 will then slope from a height of four inches at hinge 75 to two inches at end panel 27. The slope improves moisture run off, and hence, moisture repellency.

Skirt sections 23 are bounded by points flmg, hnpi and kejq. Lengths fl, gm, hn, ip, ek and jq measure four inches each. Lengths fg and lm, ih and pn, and ej and kq are parallel. A fold line f'g', h'i', e'j' is marked on each skirt section 23. Each fold line is 1 inch from and parallel to the inside edge of the corresponding skirt section 23. Thus, edge fg and fold line f'g' are parallel and lengths ff' and gg' measure one inch each; edge ej and fold line e'j' are parallel and lengths ee' and jj' measure one inch each; edge hi and fold line h'i' are parallel and lengths hh' and ii' measure one inch each. The parallel edges and fold lines define sealing flanges sections 24 within skirt sections 23. Hinge flange section 25 is bounded by points rslk. Lengths rk and sl measure two inches each. Corner sealing flange sections 26 extend one inch from edges mcn and qdp, respectively.

Figure 3:
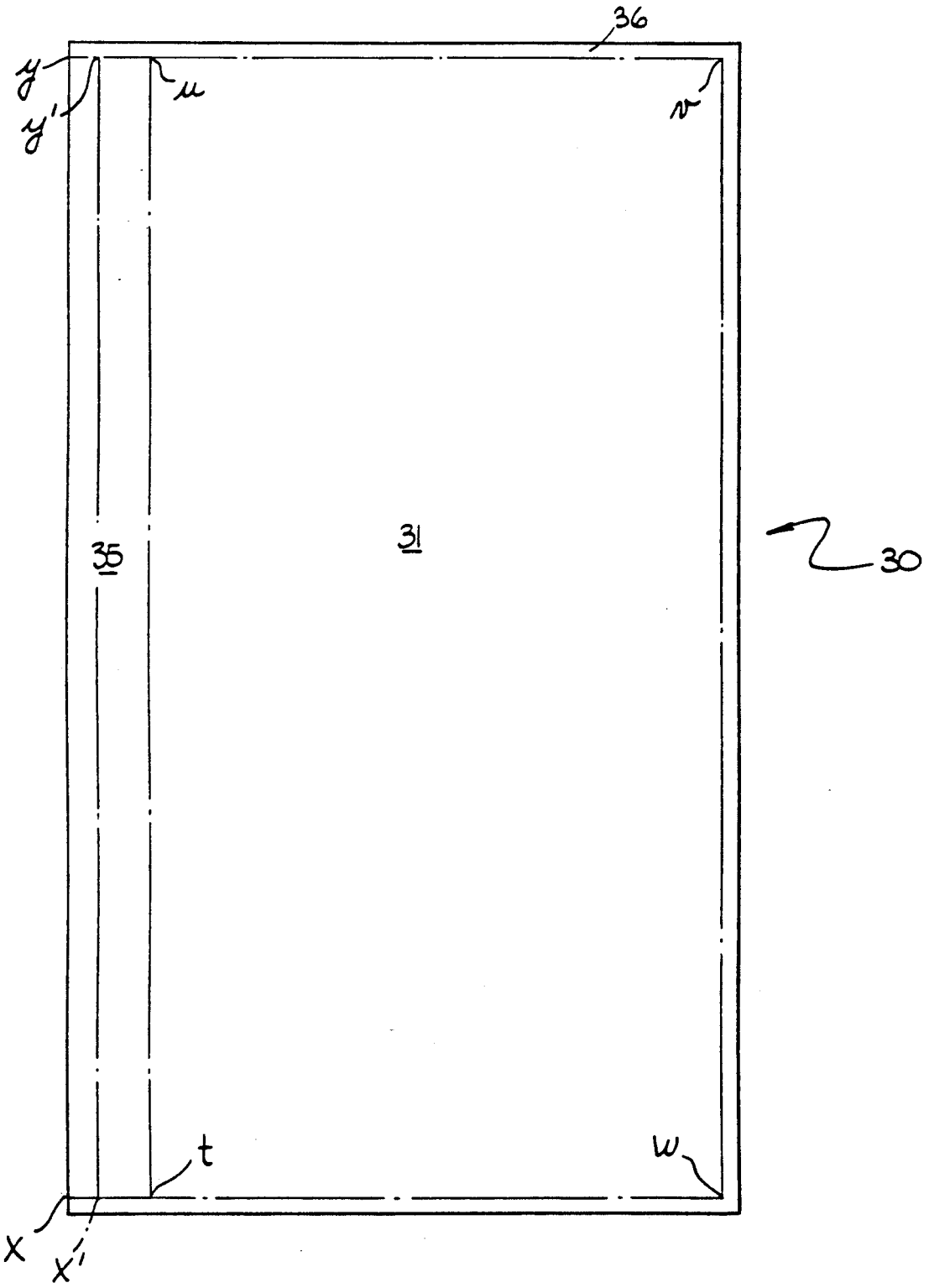
FIG. 3 is a plan view of the bottom panel of a cover half, showing various sections of the panel before folding and assembly.

Bottom panel 30 is shown in FIG. 3. Bottom panel 30 is a single piece of sheet material such as tear-resistant polyvinylchloride. Central section 31 is bounded by points tuvw. Lengths tu and vw measure 84 inches each; lengths uv and tw measure 42 inches each. Hinge flange section 35 is bounded by points xyut. Lengths xt and yu measure six inches each. Sealing line x'y' is parallel to and measures one inch from edge xy. Sealing flange section 36 extends one inch from edge yvwx.

Figure 4:
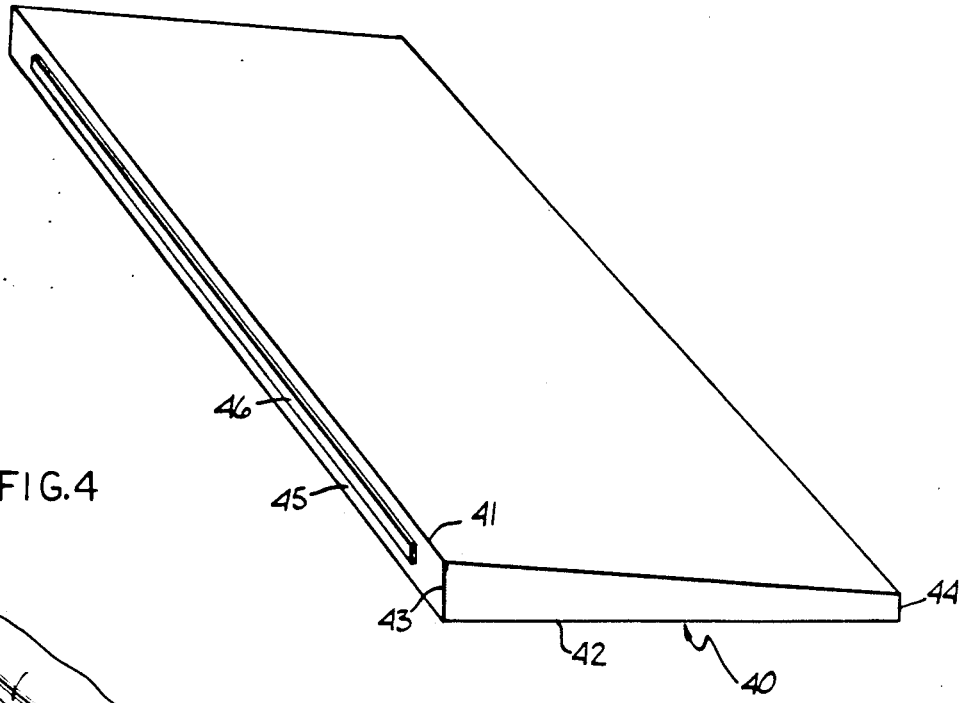
FIG. 4 is a perspective view of the rigid material insert.

Rigid material insert 40 is shown in FIG. 4. Rigid material insert 40 in the preferred embodiment is a single piece of expanded polystyrene. Rigid material insert 40 for each cover half 11 is smaller than the desired dimensions for each half of the finished cover to account for the thickness of the hinge between the cover halves 11. Edge 41 measures 84 inches; edge 42 measures 41 inches; edge 43 measures four inches; edge 44 measures two inches. A support bar 46, typically made of metal, is embedded in side 45 for strength.

When incorporated into the spa cover 10, rigid material insert 40 will be oriented so that side 45 of each insert 40 is in the middle of the cover 10 adjacent hinge 75. Edges 42 will be adjacent to top cover panel edges ej and fg and the seams between side panels 22 and skirts 23.

Briefly stated, the spa cover is constructed as follows: the handles are attached to the top panel, the corner flanges in the top panel are sealed, the bottom panel and top panel are sealed together on all edges except the edge where the hinge will be formed, the securing tabs are sealed onto the skirts, the rigid material inserts are placed between the top and bottom panels by inserting them at the open hinge edge, the hinge edge is sealed, and the hinge flanges are sealed together between the cover halves. Each step will now be described in detail.

Handles 51 are attached to top panel 20 at end panel 27. In the prior art, handles are attached to the spa cover encasement merely by sewing the handles directly onto the outside of the cover encasement. The prior art has two disadvantages. First, because the handles merely are attached to the outside of the cover encasement the exposed handle attachment sections may wear or be caught on sharp objects, severing the thread and causing the handle to come off. Second, the thread in the sewn seams in attachment sections may wick moisture through the seams into the spa cover.

The present invention overcomes these disadvantages. The handle 51 in the present invention is sealed to the sheet material of the top panel 20, producing a moisture proof attached handle with no exposed handle attachment.

Figure 5A:
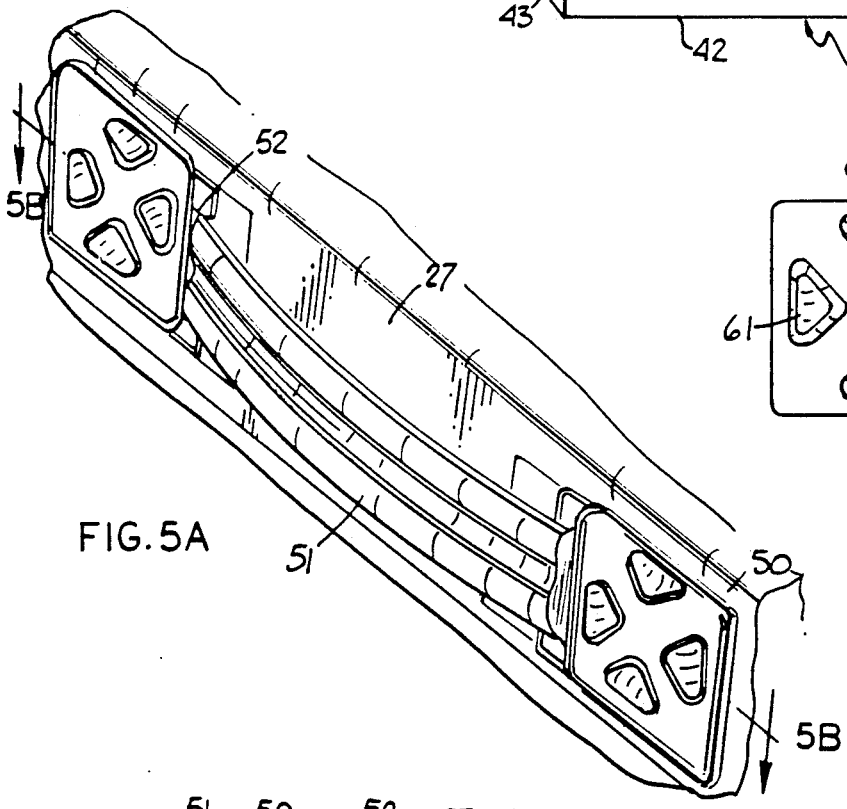
FIG. 5*a* shows a perspective view of the attachment of a handle to a side or end portion.

Handles 51 are attached as shown in FIG. 5*a*. In the preferred embodiment, two handles 51 are attached to each end panel 27. Handles 51 are positioned to be equidistant from the ends and center of end panel 27.

Figure 6:
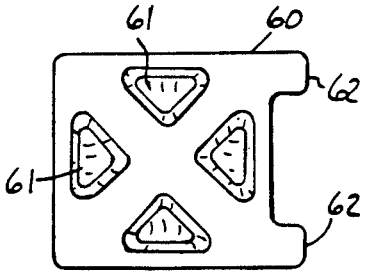
FIG. 6 is a plan view of the handle and tab die pattern.

Heat seal die 60 used for attachment of handle 51 is shown in FIG. 6. Die 60 contains recesses 61 to allow for expansion of the heated material. Die 60 also has prongs 62 which will perform an overlapping function during handle and tab attachment so as to provide a more complete seal.

Figure 5B:
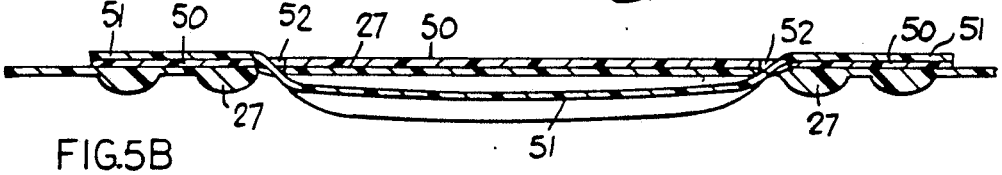
FIG. 5*b* is a section view along line 5*b*–5*b* of FIG. 5*a*.

As shown in FIG. 5*b*, in preparation of the attachment of a handle 51, the area of end panel 27 to which handle 51 is to be attached is reinforced with rip stop nylon reinforcement piece 50. Reinforcement piece 50 is heat sealed to end panel 27 on the inside surface of the cover, with the prongs 62 of the die pointed away from the center of the handle.

After reinforcement piece 50 is heat sealed to the inside of end panel 27, slit openings 52 are cut into end panel 27 and reinforcement piece 50. Openings 52 are located between the marks left by prongs 62 of die 60, so that the reinforcement piece 50 heat seals will be on the handle center side of the openings 52. The ends of handle 51 are inserted into openings 52. Die 60 is again used to heat seal end panel 27, reinforcement piece 50 and the ends of handle 51, this time with the die placed so that the handle heat seal will be opposite the handle center side of the openings 52. The die 60 is also turned 180° so that the prongs 62 of the handle heat seal overlap the prongs 62 of the reinforcement piece heat seal. In this fashion, handles 51 are securely attached to end panel 27 in a moisture-proof seal.

Figure 7B:
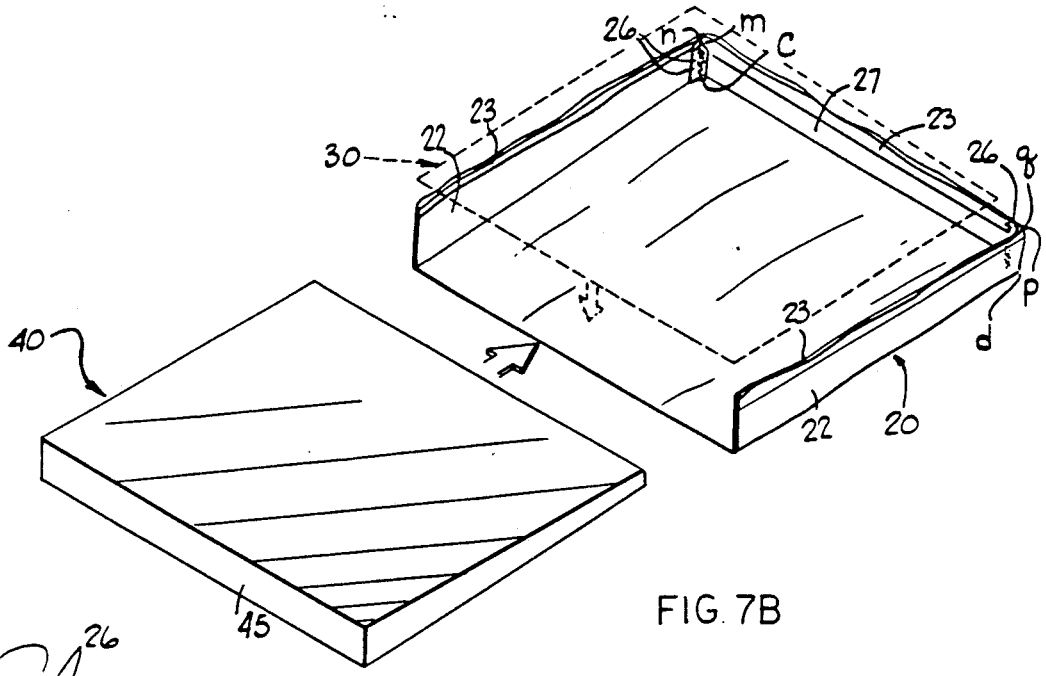
FIG. 7*b* is a perspective view of the top panel with the corner seals, the bottom panel and the rigid material insert, showing the general orientation of the elements before construction.
Figure 7A:
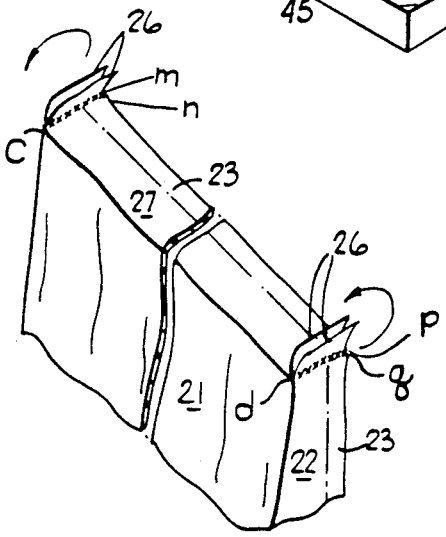
FIG. 7*a* is a perspective view of the top panel showing the corner seals, with the corners exaggerated for clarity.

The corners of the top cover are next constructed by manipulating corner sealing flanges 26 so that the outside of edges cm and cn, and edges dp and dq are in contact as shown in FIG. 7*a* (with the corners exaggerated for clarity) and in FIG. 7*b* (also showing the general orientation of top panel 20, bottom panel 30 and rigid material insert 40). The edges are then heat sealed together, and excess material of corner sealing flanges 26 is trimmed off. By sealing the outside edges together, rather than sealing the inside edges together, the excess material from corner sealing flanges 26 is on the inside of the cover encasement rather than on the outside where it can wear or be caught on sharp objects.

Figure 8B:
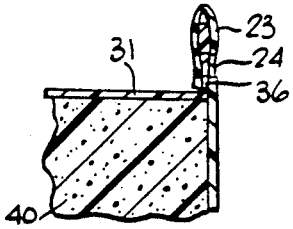
FIG. 8*b* is a sectional view along line 8*b*—8*b* of FIG. 8*a*.
Figure 8A:
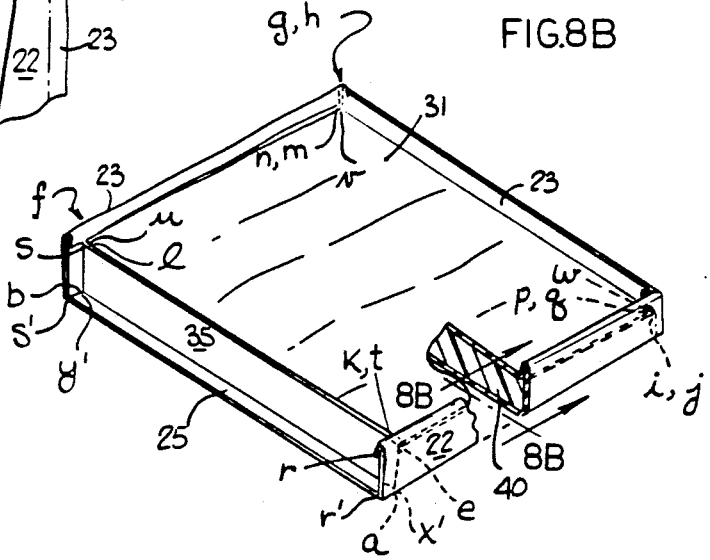
FIG. 8*a* is a perspective view of the top panel and bottom panel showing them sealed together, with the sealed portion exaggerated for clarity and also showing a partial cut-away view of the seal.

The top panel 20 and bottom panel 30 are then sealed together as shown in FIG. 8*a* to form a cover encasement assembly. Top panel 20 is placed with the inside surface (the surface that will contact the rigid material insert 40) facing up. Bottom panel 30 is placed on top panel 20, and the three outer edges of sealing flange section 36 are aligned with top panel edges f'g', h'i' and e'j'. Skirt sections 23 of top panel 20 are folded over sealing flange section 36 of bottom panel 30 so that edge lm is aligned with edge uv, edge np is aligned with edge vw, and edge kq is aligned with edge tw. A heat seal is then applied to the aligned edges. Thus, edges lm, uv and fg are sealed together, in that order looking down on the seal. Similarly, edges np, vw and hi are sealed together, and edges kq, tw and ej are sealed together.

At this stage of construction the edges are sealed with straight dies; therefore the seal terminates short of the corners at points g/h and i/j. The corners are then sealed by the use of corner dies.

Next securing tabs 28 are attached to skirts 23. The number and placement of tabs 28 will vary depending upon the size and shape of the cover and the climate conditions in which the cover is used. For example, a cover which is unusually large or which is used in unusually windy conditions may require more tabs. In the preferred embodiment one tab 28 is attached to skirt 23 at approximately the midpoint of each side panel 22.

To attach tab 28 a slit opening is made in the edge of skirt 23 where skirt section 23 was folded over sealing flange section 36. The opening is just wide enough to allow insertion of tab 28. Tab 28 is inserted into the opening in skirt 23 until the inserted end contacts the seal between skirt 23 and central section 21 and side panel 22. Skirt 23 and tab 28 are then sealed together with the same die 60 used to attach handles 51 to end panel 27.

As shown in FIG. 7*b*, rigid material insert 40 is then inserted into the cover encasement assembly, with end 45 at the opening of the cover encasement assembly.

Figure 9:
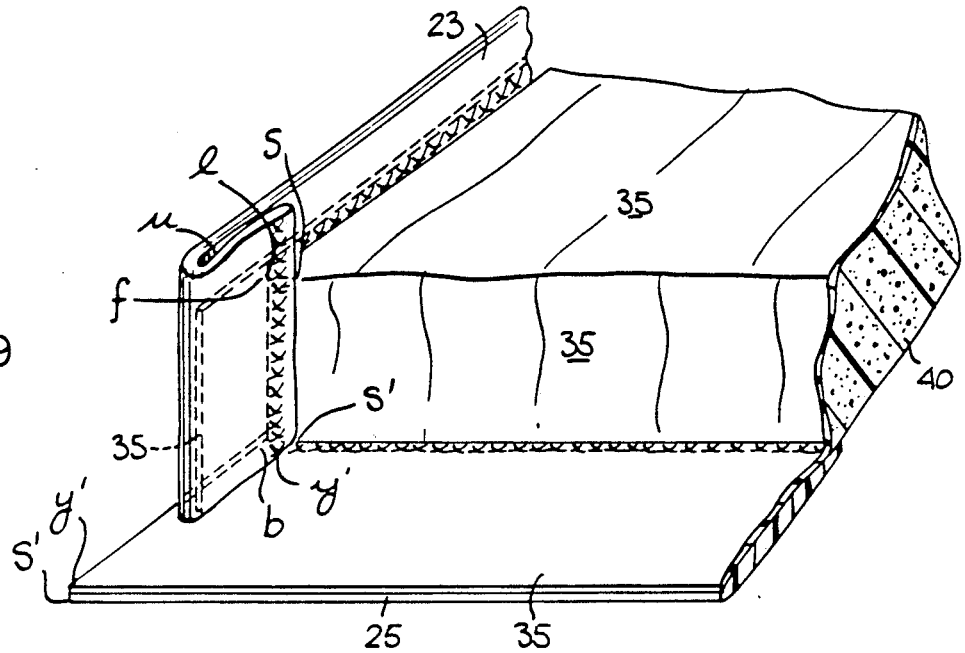
FIG. 9 is a perspective view of a cover half after the top panel and bottom panel are completely sealed around the rigid material insert.

As shown in FIG. 8*a* and FIG. 9, bottom panel hinge flange section 35 is then pulled tight and folded down over rigid material end 45. Hinge flange section 35 is sealed to top panel 20 so that sealing line x'y' on hinge flange section 35 is sealed to edge ab on top panel 20.

A cut is made in top panel hinge flange section 25 along lines r'a and s'b. Edge ss' is folded over the portion of bottom panel sealing flange section 36 from point u to y' so that points s, l, u and f are aligned. A seal is made at the folded edge ss' along the entire length of the fold, from where points s', y' and b are aligned to where points s, l, u and f are aligned and through flap section 23, as shown in FIG. 9. A similar fold-and-seal process is applied to the other end of flange sections 25 and 35. These seals produce a moisture-proof seal entirely around rigid material insert 40.

Figure 10A:
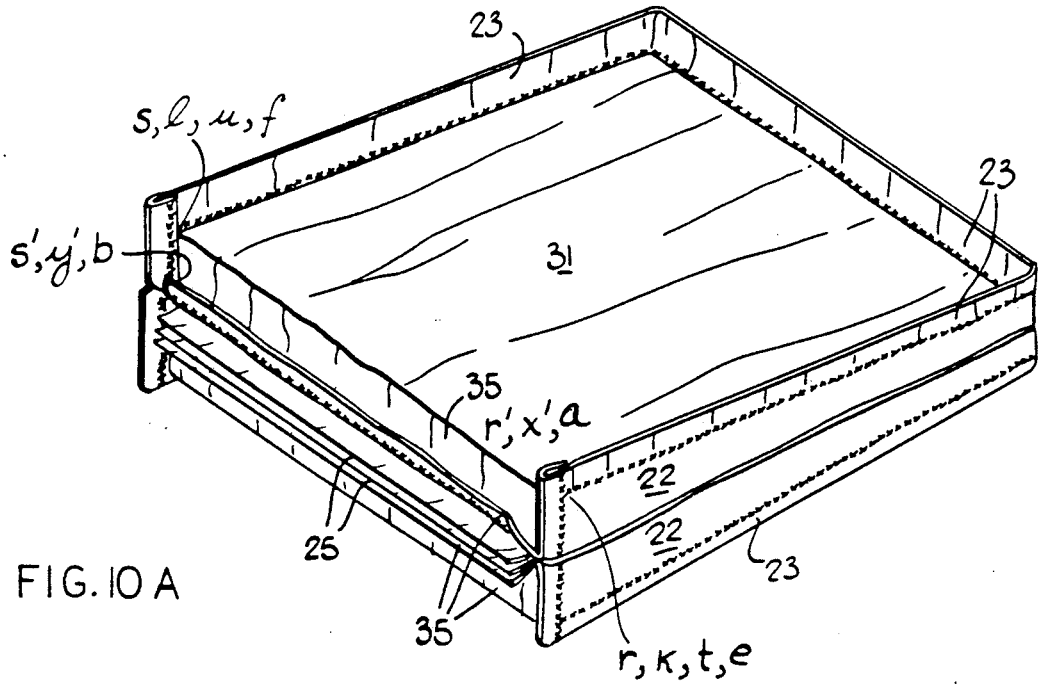
FIGS. 10*a* and 10*b* show steps in construction of the hinge portion between the cover halves.

Each cover half 11 is constructed by this method. The completed cover halves 11 are placed one on top of the other so that their top panel center sections 21 are in contact as shown in FIG. 10*a*. The sheet material extending from hinge flange sections 25 and 35 from each cover half 11 is heat sealed along top panel edge ab and bottom panel sealing line x'y'. This seal produces a hinge flange between the cover halves 11.

Figure 10B:
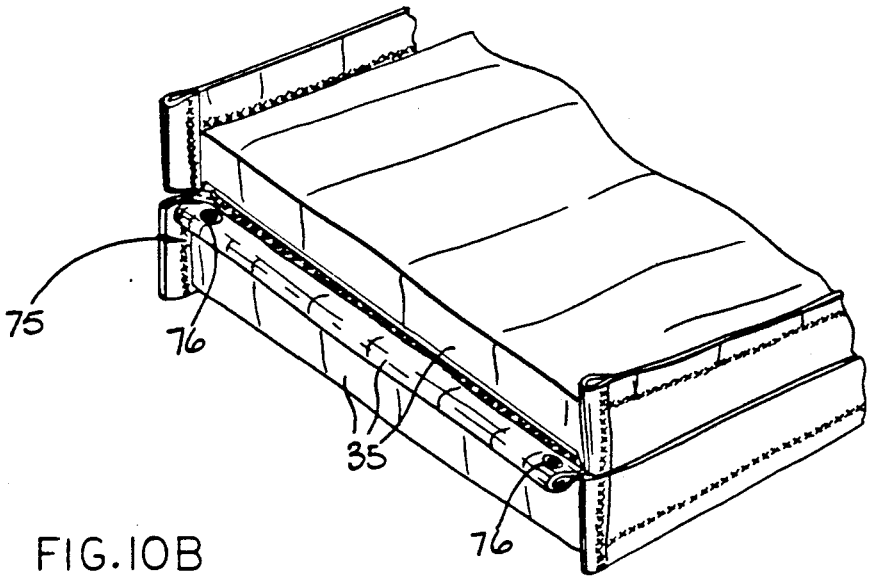

It has been discovered, however, that a second seal strengthens the hinge. Thus, sheet material of hinge flange sections 25 and 35 extending from the first hinge seal along edge ab and sealing line x'y' is folded over onto itself so that edges r's' and xy are aligned with the first hinge seal along edge ab and sealing line x'y'. As shown in FIG. 10*b*, edges r's' and xy are then sealed to the first hinge seal, so that eight thicknesses of material are sealed together along edges xy, r's' and ab and sealing line x'y'. As additional reinforcement for hinge 75, a rivet or grommet 76 is placed in hinge 75 at each end. This seal-fold-seal sequences produces hinge 75 between cover halves 11 as shown in FIG. 10*b* and FIG. 11.

What is claimed is:

1. An apparatus to protect a spa, comprising a first cover with:

a one-piece insulating insert having a top surface and bottom surface;

a substantially unitary flexible top panel sheet made of a durable weather resistant and water proof material and having an inner side surface, an outer side surface and a periphery, said top panel covering said insert, with said top panel inner side surface in direct contact with said insert top surface and said top panel outer side surface being exposed;

a substantially unitary flexible bottom panel sheet made of a durable weather resistant and water proof material and having an inner side surface, an outer side surface and a periphery, said bottom panel covering said insert, with said bottom panel inner side surface in direct contact with said insert bottom surface and said bottom panel outer side surface being exposed, and substantially all of said bottom panel periphery being attached to substantially all of said top panel periphery so that said insert is protected from moisture.

2. The apparatus of claim 1, wherein said top panel is cut from a single sheet of material and said bottom panel is cut from a single sheet of material.

3. The apparatus of claim 2, wherein:

said insert has sides;

said top panel includes at least one integral side panel to cover said insert sides; and at least a portion of said top panel periphery is in said integral side panels, so that the seal between said top panel and bottom panel includes a seal between said side panel and said bottom panel.

4. The apparatus of claim 3, wherein said integral side panel and said bottom panel include flanges, and said side panel flange is folded to cover both sides of said bottom panel flange at said seal, and said seal is through said bottom panel flange and the folded side panel flange.

5. The apparatus of claim 4, wherein said bottom panel flange is folded approximately 90° so that it folds over the outside edge of said spa, and said side panel flange folds over both sides of said bottom panel flange and is sealed thereto to form a protective skirt over the edge of said spa.

6. The apparatus of claim 5, wherein the periphery of said side panels include sealing flanges to seal to an adjacent side panel, and wherein said sealing flanges are sealed together with their outer surfaces in contact with one another so that the edges of said flanges are in contact with the insert.

7. The apparatus of claim 6, further comprising a second cover substantially the same as said first cover and attached to said first cover.

8. The apparatus of claim 7, wherein said first and second covers are attached along attaching sides with a hinge extending the length of said sides.

9. The apparatus of claim 8, wherein said hinge is a seal between the periphery of at least one of said top panel and bottom panel of said first cover, and at least one of said top panel and bottom panel of said second cover.

10. The apparatus of claim 9, wherein;

said insert of each of said first cover and second cover has a side adjacent said hinge;

said bottom panel of each of said first cover and second cover includes an integral side panel to cover said insert sides adjacent said hinge;

at least a portion of the periphery of said bottom panels is in said side panel covering said insert sides adjacent said hinge of each of said first cover and second cover, so that the seal between said top panel and said bottom panel of each of said first cover and second cover includes a seal between said side panel covering said insert sides adjacent said hinge and said top panel of each of said first cover and second cover;

said sealing hinge is at the seal between said side panels covering said insert sides adjacent said hinge and said top panels.

11. The apparatus of claim 10, wherein said side panels covering said insert sides adjacent said hinge, and said top panels, include a hinge sealing flange extending from said hinge seal, and said hinge sealing flange is folded parallel to said hinge seal and the hinge sealing flange edge is sealed to said hinge seal to further strengthen said hinge seal.

12. The apparatus of claim 11, wherein a plurality of substantially parallel pairs of slit openings are in said side panels covering said insert sides, each end of a handle is inserted into each of said openings, and said handle ends are sealed to said side panels.

13. A method of manufacturing an apparatus to protect a spa, comprising constructing a first cover by:

forming a one-piece insulating insert having a top surface and a bottom surface;

cutting out a substantially unitary flexible top panel sheet made of a durable weather resistant and water proof material, with an inner side surface, an outer side surface and a periphery;

cutting out a substantially unitary bottom panel sheet made of a durable weather resistant and water proof material, with an inner side surface, an outer side surface and a periphery;

attaching a portion of said top panel periphery to said bottom panel periphery to form an envelope with the outer sides of said top panel and bottom panel on the outside of the envelope;

inserting said insert into said envelope;

attaching substantially all of the unattached periphery of said top panel to substantially all of the unattached periphery of said bottom panel so that the insert is protected from moisture;

constructing a second cover substantially the same as said first cover;

hingedly attaching said first cover to said second cover by attaching a flange of a panel sheet of the first cover to a panel sheet of the second cover.

14. The method of claim 13, in which said insert has sides and said top panel includes a plurality of side panels integral with said top panel to cover said insert sides and each side panel that is adjacent to another side panel includes a sealing flange on the side panel adjacent edge, further comprising sealing together said side panel sealing flanges at corners of the insert with their outer sides in contact so that the flange edges are in contact with the insert corner.

15. The method of claim 14, in which said side panel and said bottom panel include flanges, further comprising folding said side panel flange cover to cover both sides of said bottom panel flange and sealing through said bottom panel flange and said folded side panel flange.

16. The method of claim 15, in which said hinged attachment is along attaching sides of said first cover and second cover, said inserts have a side adjacent said hinge, said bottom panels include an integral side panel to cover said insert sides adjacent said hinge, at least a portion of the periphery of said bottom panels is in said side panels to cover said insert sides adjacent said hinge so that sealing said top panels and said bottom panels together includes sealing said top panels together and includes sealing said top panels to said side panels to cover said insert sides adjacent said hinge; further comprising sealing said first cover and said second cover together at said seal between said top panels and said side panels to cover said insert sides adjacent said hinge.

17. The method of claim 16, in which said side panels covering said insert sides adjacent said hinge and said top panels include a hinge sealing flange extending from said hinge seal, further comprising folding said hinge sealing flange parallel to said hinge seal and sealing the hinge sealing flange to said hinge seal to further strengthen said hinge seal.

18. The method of claim 17, further comprising making a plurality of substantially parallel pairs of slit openings in said side panels covering said insert sides, inserting each end of a handle into each of said openings and sealing said handle ends to said side panels.

* * * * *